United States Patent [19]

King, Jr. et al.

[11] 4,286,193

[45] Aug. 25, 1981

[54] STARTING AND OPERATING CIRCUIT FOR GAS DISCHARGE LAMP

[75] Inventors: Ralph W. King, Jr., Streamwood; Hans U. Hjermstad, Chicago, both of Ill.

[73] Assignee: Johnson Electric Coil Company, Elmhurst, Ill.

[21] Appl. No.: 11,195

[22] Filed: Feb. 12, 1979

[51] Int. Cl.[3] ..... H05B 41/16

[52] U.S. Cl. ..... 315/175; 315/171; 315/277; 315/289; 315/362; 365/DIG. 5

[58] Field of Search ..... 315/171, 175, 205, 257, 315/277, 278, 280, 282, 289, 362, DIG. 5, DIG. 7

[56] References Cited

U.S. PATENT DOCUMENTS

| | | | |
|---|---|---|---|
| 2,694,177 | 11/1954 | Sola | 323/60 |
| 2,804,588 | 8/1957 | Hjermstad | 363/75 |
| 2,825,005 | 2/1958 | Bird | 315/280 X |
| 3,334,270 | 8/1967 | Nuckolls | 315/175 X |
| 3,474,290 | 10/1969 | Swain | 315/175 X |
| 3,483,428 | 12/1969 | LaPlante | 315/151 |
| 3,500,128 | 3/1970 | Liepins | 315/278 |
| 3,644,780 | 2/1972 | Koyama et al. | 315/205 X |
| 3,701,925 | 10/1972 | Nozawa et al. | 315/DIG. 5 |
| 3,732,460 | 5/1973 | Wattenbach | 315/123 |
| 3,746,920 | 7/1973 | Flatley | 315/171 X |
| 3,767,970 | 10/1973 | Collins | 315/DIG. 5 |
| 3,944,876 | 3/1976 | Helmuth | 315/205 |

OTHER PUBLICATIONS

Hjermstad, *Static-Magnetic Regulated D-C Power Supplies*, Electrical Manufacturing, Dec. 1958.

*Sola Constant-Voltage Transformer—Theory of Design and Operation*, pp. 4–10, copyright 1954.

*Primary Examiner*—Eugene R. LaRoche

*Attorney, Agent, or Firm*—Vogel, Dithmar, Stotland, Stratman & Levy

[57] ABSTRACT

Starting and operating power is provided to a gas discharge lamp by a circuit which includes a constant-voltage current-limiting ferroresonant transformer connected to an AC source and having high and low voltage output terminals. A full-wave rectifying bridge is selectively connectable to either the high or low voltage output terminals by relay control means which includes a choke coil connected in series with the lamp and a magnet reed. On starting of the lamp the magnetic flux of the choke coil operates the reed for shifting to the low voltage condition, and on extinguishing of the lamp the collapse of the choke coil flux operates the reed for shifting to the normal high voltage condition. A transient high voltage starting pulse is applied to the lamp across a spark gap by a pulse generating starting circuit in which a capacitor, charged from the DC output, is discharged through a self-commutating SCR and an ignition transformer. The transient pulse is effectively blocked from the DC supply by the choke coil and two diodes. Capacitive discharge means is also provided for maintaining operating voltage to the lamp during the switching of the power supply. For higher power applications there is provided an alternative AC supply circuit utilizing two constant-voltage current-limiting ferroresonant transformers, the control means switching the transformers between series and parallel connection for high and low voltage output, respectively.

15 Claims, 7 Drawing Figures

STARTING AND OPERATING CIRCUIT FOR GAS DISCHARGE LAMP

BACKGROUND OF THE INVENTION

The present invention relates to a circuit for starting and operating a gas discharge lamp. More particularly, the present invention relates to an improved circuit for starting a gas discharge lamp regardless of the lamp temperature and for operating the lamp on DC voltage over a wide range of input voltage.

Gas discharge lamps, such as mercury vapor lamps, have a wide variety of uses, e.g., graphic arts plate development, printed circuit development, paint and epoxy curing, street lighting and as an ultraviolet source for fiber optics. While such lamps have many advantages, they have the drawback of being extremely difficult to restart when extinguished, even momentarily, after having been warmed up, since the relatively high vapor pressure in the hot lamp necessitates extremely high starting voltages. Thus, normally the lamp must be allowed to cool down for several minutes before restarting, which outage may constitute a severe drawback in certain applications. When started cold such lamps typically require several minutes to warm up to normal operating temperature and full light output.

Circuits have been provided for the rapid restarting of gas discharge lamps. One such circuit is disclosed in U.S. Pat. No. 3,944,876, issued to James G. Helmuth on Mar. 16, 1976, and in U.S. Pat. No. 3,732,460, issued to H. L. Wattenbach on May 8, 1973. But both of these prior devices are for use where AC voltage is applied to the lamp terminals, which tend to be less efficient than DC operated lamps, normally requiring higher operating voltages. Such circuits may utilize transient starting voltages of about 15,000 volts or higher, which present serious safety problems. Also, these devices are susceptible to the often substantial variations in AC line voltage.

Other starting circuits have been provided for use with lamps having DC operating voltage applied to the terminals thereof, such circuits being disclosed, for example, in U.S. Pat. No. 3,483,428, issued to D. E. LaPlante on Dec. 9, 1969, and U.S. Pat. No. 3,767,970, issued to J. R. Collins on Oct. 23, 1973. Both of these prior devices, as well as the starting circuits for AC-operated lamps discussed above, utilize transformer coupling of a high voltage transient starting pulse to one of the lamp electrodes simultaneously with the application of the operating voltage. Furthermore, these devices also fail to provide regulation of the power supply output over variations in input AC line voltage, and the starting circuits for DC-operated lamps are quite complicated.

SUMMARY OF THE INVENTION

The present invention relates to an improved circuit for starting and operating a gas discharge lamp on DC voltage which avoids disadvantages of prior art devices and affords additional important operating and structural advantages.

It is a general object of this invention to provide an improved circuit for starting and operating a gas discharge lamp on DC voltage over a wide range of AC input voltage.

It is another object of this invention to provide an improved circuit of the character described, which affords controlled rapid warm-up of the lamp and automatic instant restarting of a hot lamp.

In connection with the foregoing object, it is another object of this invention to provide a circuit of the type set forth whereby a hot lamp is restarted by automatic boosting of the operating DC voltage well above the normal running voltage and simultaneously applying a high voltage transient starting pulse to the lamp electrodes.

In connection with the foregoing object, it is another object of this invention to provide a circuit of the type set forth, which automatically switches to a low voltage running condition in response to ignition of the lamp.

Still another object of this invention is the provision of a circuit of the type set forth, wherein the DC and transient portions of the circuit are effectively isolated from each other and the transient starting pulse is concentrated in the lamp.

In summary, these objects are attained by providing a circuit for starting and operating a gas discharge lamp comprising means connecting the lamp to an associated source of DC voltage, a starting circuit for producing a transient pulse of starting voltage, and spark means connected to said starting circuit and the lamp for coupling said transient voltage pulse to the lamp to start same while preventing feedback of the DC voltage to said starting circuit.

Further features of the invention pertain to the particular arrangement of the parts of the circuitry whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
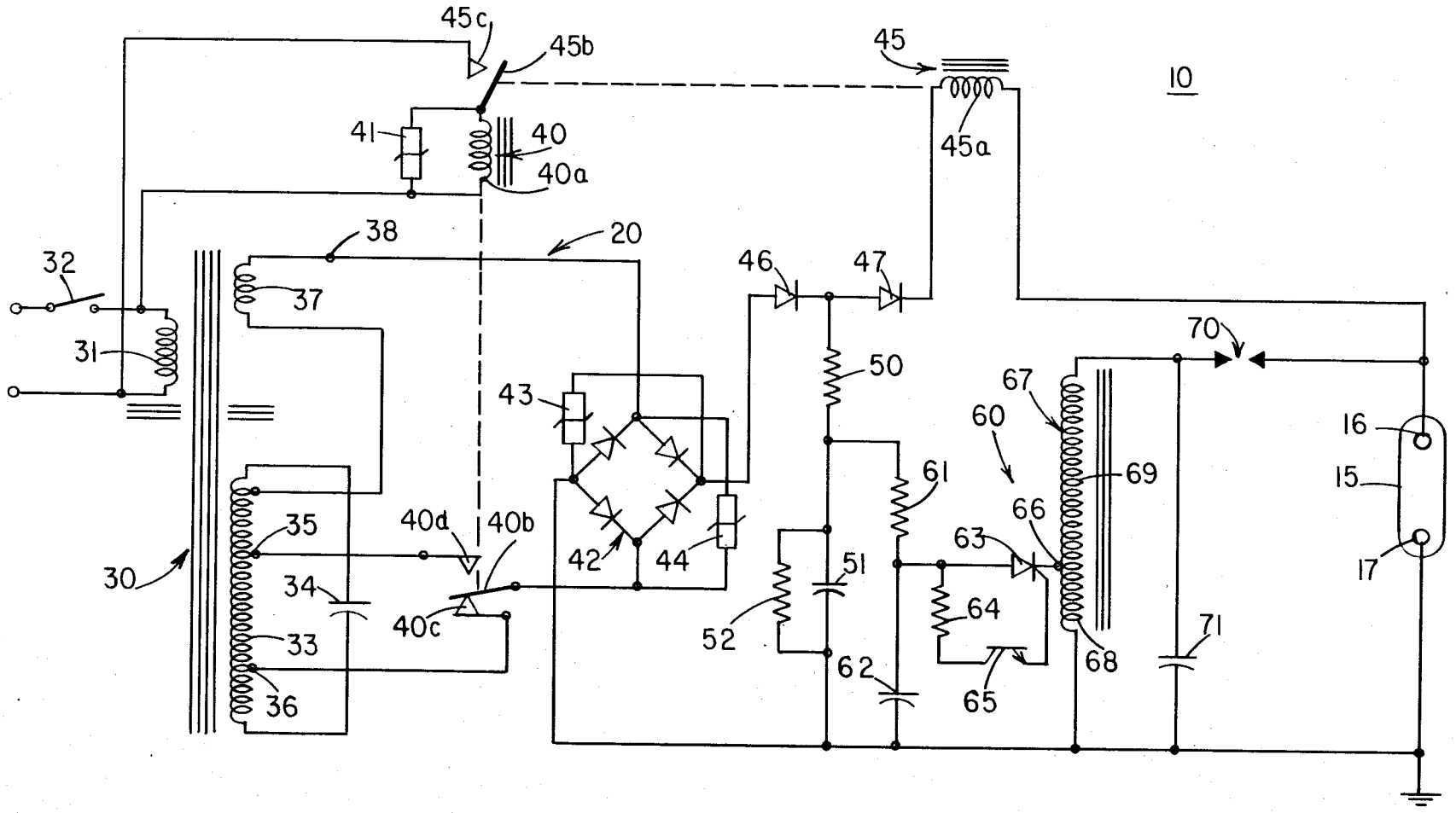
FIG. 1 is a schematic circuit diagram of a gas discharge lamp connected to starting and operating circuitry constructed in accordance with and embodying the features of the present invention.
Figure 2:
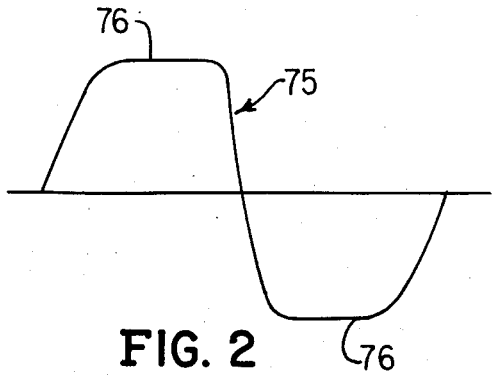
FIG. 2 is a waveform diagram illustrating the typical wave shape of the voltage at the output of the ferroresonant transformer of the present invention.

Referring now to FIG. 1 of the drawings, there is illustrated a circuit, generally designated by the numeral 10, constructed in accordance with and embodying the features of a first embodiment of the present invention for starting and operating a lamp 15. The lamp 15 is a gas discharge lamp, such as a mercury vapor lamp, and has electrodes 16 and 17, the latter being connected to ground. The circuit 10 includes a power supply, generally designated by the numeral 20, for producing a DC output voltage, and a starting circuit, generally designated by the numeral 60, for applying a high-voltage transient starting pulse to the lamp 15.

The power supply 20 includes a transformer, generally designated by the numeral 30, which is of the constant-voltage current-limiting type, such transformers being disclosed, for example, in U.S. Pat. No. 2,694,177, issued to J. G. Sola on Nov. 9, 1954, and U.S. Pat. No. 2,804,588, issued to H. U. Hjermstad on Aug. 27, 1957. The transformer 30 has a primary winding 31 connected through an ON-OFF switch 32 across an associated source of AC line voltage, typically single-phase, 120-volt, 60 hertz. While a single primary winding has been illustrated, it will be understood that two primary windings could be used, each connected between neutral and one of the power lines of a 240-volt AC supply. In like manner, additional primary windings could be utilized for a 480-volt supply or the like, depending upon the voltage requirements of the particular source with which the circuit 10 is to be used.

The transformer 30 also has a secondary winding 33 across which is connected a capacitor 34, the capacitor 34 having a value such that at the frequency and voltage of the AC source it is ferroresonant with the secondary winding 33 when the device is in operation, in a well-known manner. The secondary winding 33 has intermediate taps 35 and 36 respectively corresponding to low voltage and high voltage output terminals of the transformer 30. The upper end of the secondary winding 33 is connected in series with a compensating winding 37, the opposite end of which provides an output terminal 38 for the transformer 30.

Connected in series across the primary winding 31 of the transformer 30 are a coil 40*a* of a relay 40 and normally open contacts 45*b* and 45*c* of a magnetic reed relay 45. The relay 40 has a movable contact 40*b* and two fixed contacts 40*c* and 40*d* which are respectively connected to the taps 36 and 35 of the secondary winding 33 of the transformer 30. The relay 40 is normally de-energized, in which condition the movable contact 40*b* is in engagement with the fixed contact 40*c*. A varistor 41 is connected in parallel with the coil 40*a* of the relay 40 to protect the solid-state circuits described below from inductive voltage spikes of the relay coil 40*a*.

The output terminal 38 of the transformer 30 and the movable contact 40*b* of the relay 40 are respectively connected to the input terminals of a full-wave rectifying diode bridge 42, one of the output terminals of which is connected to ground and the other output terminal of which is connected to the anode of a diode 46. The cathode of the diode 46 is in turn connected to the anode of a diode 47, the cathode of which is connected to one terminal of a choke coil 45*a*, the other terminal of which is connected to the electrode 16 of the lamp 15. The magnetic flux of the choke coil 45*a* is used to operate a magnetic reed (not shown), thereby forming the reed relay 45, which is normally de-energized when the lamp 15 is extinguished for holding the contacts 45*b* and 45*c* in their normally open position, illustrated in FIG. 1. The diode bridge 42 is preferably protected from high voltage transients by varistors 43 and 44 which are respectively connected across the input terminals and the output terminals of the diode bridge 42. Connected between ground and the junction between the diodes 46 and 47 is the series combination of a resistor 50 and a capacitor 51, a bleeder resistor 52 being connected in parallel with the capacitor 51.

The starting circuit 60 includes a resistor 61 and a capacitor 62 connected in series between ground and the junction between the resistor 50 and the capacitor 51. The junction between the resistor 61 and the capacitor 62 is connected to the anode of a silicon controlled rectifier (SCR) 63. Connected in series between the anode and the gate electrode of the SCR 63 are a resistor 64 and a diac 65. The cathode of the SCR 63 is connected to a tap 66 of an autotransformer, generally designated by the numeral 67. The tap 66 divides the autotransformer 67 into a lower or primary section 68, the other end of which is connected to ground, and an upper or secondary section 69, the other end of which is connected to one terminal of a spark gap 70, the other terminal of which is connected to the electrode 16 of the lamp 15. Connected in parallel with the autotransformer 67 is a tuning capacitor 71.

Referring now also to FIGS. 2 through 6 of the drawings, the operation of the circuit 10 will now be described. Initially, when the lamp 15 is extinguished, the power supply 20 is in a normal or starting condition, illustrated in FIG. 1, wherein the relays 40 and 45 are de-energized and the diode bridge 42 is connected across the high-voltage output terminals of the transformer 30. When the switch 32 is closed, AC voltage is applied to the primary winding 31 of the transformer 30, inducing a stepped-up AC voltage across the output terminals 36 and 38. It is an important feature of the transformer 30 that this output voltage has a waveform 75, illustrated in FIG. 2, which is substantially square in shape having substantially flattened tops and bottoms 76. This is because the current drawn by the capacitor 34 generates additional flux so that the secondary core leg of the transformer 30 operates near saturation, in a well-known manner. This generally square wave shape, when full-wave rectified by the diode bridge 42, results in a substantially ripple-free DC voltage.

It is another important advantage of the constant voltage transformer 30 that it provides effective regulation of the output voltage over a wide range of input voltage variation, as well as providing effective load regulation from no load to full load at rated input. Because of the substantially square shape of its waveform, the transformer output voltage has a crest factor of substantially 1 and, therefore, the regulation of the DC voltage at the output of the rectifying bridge 42 is substantially the same as the regulation of the AC voltage at the output of the transformer 30. Thus, the power supply 20 provides an effective, low-ripple, constant-voltage DC source.

In the embodiment illustrated in FIG. 1, the output voltage of the rectifying bridge 42 in the starting condition of the power supply 20, illustrated in FIG. 1, is approximately 400 VDC, which is applied to the lamp 15 through the diodes 46 and 47 and the choke coil 45*a*, which provides further filtering of the DC voltage and surge limiting. The DC output voltage of the power supply 20 also charges the capacitor 51 through the resistor 50 and charges the capacitor 62 through the resistors 50 and 61, the charging time of both these capacitors being approximately one second. The capacitor 51 also serves to further reduce ripple in the DC voltage supplied from the power supply 20. The resistor 52 is a bleeder resistor for slow discharge of the capacitor 51 when the circuit 10 is not in use.

Figure 4:
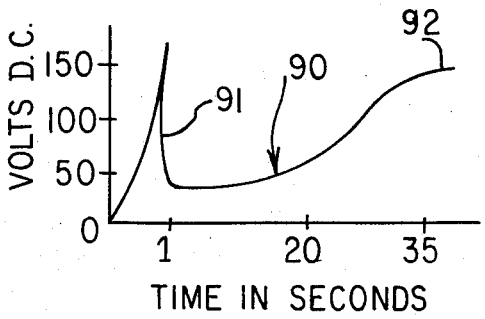
FIG. 4 is a plot of lamp voltage versus time during cold starting of the lamp with the circuitry of the present invention.

Referring to FIG. 4 of the drawings, there is illustrated a curve 90 which is the plot of lamp voltage against time for cold starting of the lamp 15. When the lamp is cold, it will ignite when the voltage thereacross reaches somewhere in the range of between 150 and 200 VDC. Thus, when the power supply 20 is turned on, the voltage across the lamp 15 will rapidly build toward the 400 VDC output voltage of the power supply 20, but before it reaches that level, the lamp 15 will ignite as at 91 in FIG. 4, before the capacitor 62 has become fully charged and, therefore, before the production of the transient voltage pulse from the starting circuit 60, as will be explained more fully below. When ignited, the lamp 15 conducts and the voltage thereacross drops rapidly, and then gradually begins to build up, as can be seen from the curve 90 in FIG. 4, while the lamp 15 warms up toward its 150-volt normal operating voltage at 92, the warm-up time being approximately 35 seconds.

As soon as the lamp 15 is ignited and current begins to flow therethrough, this current produces a magnetic field around the choke coil 45*a* for energizing the relay 45 and moving the contacts 45*b* and 45*c* to their closed position, thereby energizing the relay 40. Upon energization of the relay 40, its movable contact 40*b* switches to the fixed contact 40*d* for connecting the rectifying bridge 42 across the low-voltage output terminals of the transformer 30, and for supplying approximately 150 VDC normal operating voltage to the lamp 15.

As the movable contact 40*b* of the relay 40 switches to the running condition of the power supply 20, there is a momentary interruption of the AC voltage supplied to the rectifying bridge 42 of the power supply 20. In order to prevent the lamp 15 from becoming extinguished during this momentary interruption, the capacitor 51 rapidly discharges during this hiatus through the resistor 50 for maintaining the voltage supply to the lamp 15, the discharge current being limited by the resistor 50.

Figure 3:
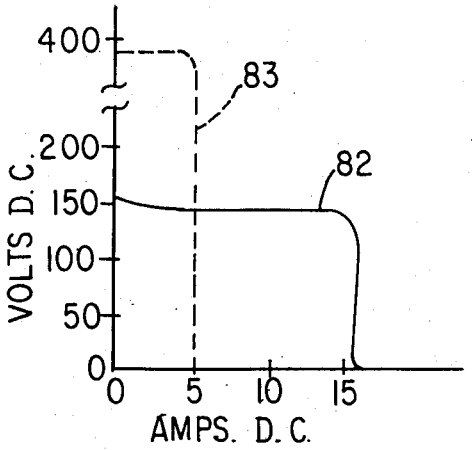
FIG. 3 is a plot of the characteristic curves of voltage versus current for the ferroresonant transformer of the present invention.

Referring to FIG. 3 of the drawings, there is illustrated a voltage-current characteristic curve 82 of the transformer 30. It is a significant feature of the present invention that the transformer 30 serves a current-limiting as well as a voltage-regulating function. The characteristic curve 82 represents the conditions when the power supply 20 is in its low-voltage or running condition. During warm-up from a cold start the lamp 15 draws a large current, and during this time the transformer 30 acts as a constant-current device limiting the lamp current to appoximately 15 amps, which is sufficient to obtain full lamp output fairly rapidly (about 35 seconds) without damage to the electrodes and seals of the lamp. When the lamp 15 reaches its normal operating voltage of about 150 volts, the transformer 30 is then in a constant-voltage mode and regulates the lamp output over a wide range of input voltage from the AC line.

Should the lamp 15 be extinguished, the circuit 10 functions automatically immediately to restart the lamp. When the lamp 15 is extinguished, as by having the operating voltage thereof interrupted, the lamp current ceases, which causes the magnetic flux of the choke coil 45*a* to collapse, whereby the relay 45 becomes de-energized, returning the contacts 45*b* and 45*c* to their normal open condition. This de-energizes the relay 40, returning its movable contact 40*b* to the normal high voltage or starting condition illustrated in FIG. 1 for applying 400 VDC to the terminals of the lamp 15.

Figure 5:
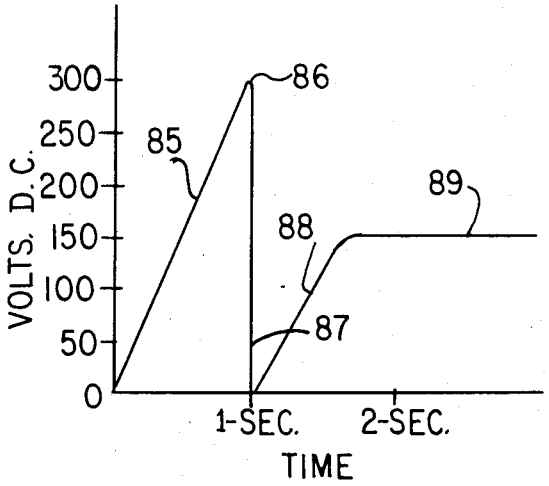
FIG. 5 is a plot of the voltage versus time on a capacitor which produces the transient starting pulse in the present invention.

While the 400 VDC applied to the lamp electrodes is normally more than sufficient to start conduction in the lamp 15 when it is cold, it is inadequate for restarting a hot lamp. Thus, for restarting a hot lamp, an additional transient voltage pulse is applied to the lamp electrode 16 by the starting circuit 60. Referring to FIG. 5 of the drawings, there is shown a plot of the voltage on the capacitor 62. The capacitor 62 charges as at 85 until the voltage thereon reaches approximately 300 volts at 86, at which point the voltage across the diac 65 reaches the triggering level for switching the diac to its conductive state for applying a pulse of energy to the gate electrode of the SCR 63, thereby triggering the SCR 63 to its conductive state, whereupon the capacitor 62 rapidly discharges, as at 87 in FIG. 5, through the SCR 63 and the primary section 68 of the autotransformer 67. There is, thus, induced in the secondary section 69 of the autotransformer 67 a high voltage transient pulse which creates a spark across the spark gap 70 using the Tesla effect for applying the voltage pulse to the electrode 16 of the lamp 15, at the same time as the 400 VDC is being applied thereto. The capacitor 71 serves to tune the spark gap 70. The transient voltage pulse applied to the lamp 15 by the starting circuit 60 may be as high as 8,000 volts peak-to-peak, and is sufficient along with the 400 VDC to ignite the lamp 15, whether it is hot or cold.

As the voltage pulse from the capacitor 62 through the primary section 68 of the ignition transformer 67 decays, there is induced in the transformer 67 a voltage which is applied to the cathode of the SCR 63 for reverse-biasing it and turning it off. This self-commutation of the SCR 63 permits recharging of the capacitor 62. As soon as the capacitor 62 has discharged, it begins to charge again as at 88 in FIG. 5. But before it can reach the full charge of 300 volts, the power supply 20 is switched to its low-voltage running condition as explained above, in response to current in the ignited lamp, so that only 150 VDC is available for charging the capacitor 62. Thus, the charge on the capacitor 62 levels off at approximately 150 VDC, as at 89 in FIG. 5.

Figure 6:
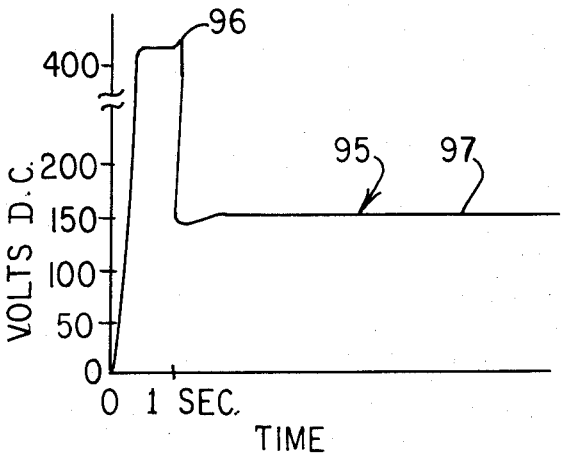
FIG. 6 is a plot of lamp voltage versus time during hot starting of the lamp with the circuitry of the present invention.

Referring to FIG. 6 of the drawings, there is illustrated a curve 95 which is a plot of the lamp voltage against time during restarting of a hot lamp. As can be seen, the lamp voltage rapidly reaches the approximately 400 VDC output of the power supply 20 immediately after it has been switched back to its starting condition. When the starting circuit 60 operates, the transient starting pulse is applied to the lamp as at 96. The lamp ignites and the voltage thereacross rapidly drops and levels off at about 150 VDC, as at 97, after the power supply 20 has switched to its low-voltage running condition.

If, for some reason the lamp 15 does not start on the first application of the transient voltage pulse from the starting circuit 60, the power supply 20 will remain in its starting condition and the capacitor 62 will again recharge completely to the full 300-volt potential for applying another transient voltage pulse to the lamp 15. Thus, the starting circuit 60 acts as a sawtooth oscillator which will repeatedly apply high voltage transient pulses to the lamp 15 at about 1-second intervals until it starts.

Referring again to FIG. 3 of the drawings, there is illustrated at 83 the voltage-current characteristic curve of the transformer 30 when operated in the high-voltage or starting condition thereof, as in restarting a hot lamp. It can be seen that in this condition, the transformer 30 serves to limit the starting current to the lamp to 5 amps.

It will be noted that the starting circuit 60 is such that it will not operate until the voltage applied to the RC network of the resistor 61 and capacitor 62 is well above the normal 150 VDC operating voltage of the lamp 15. Thus, the oscillator of the starting circuit 60 is automatically shut off as soon as the power supply 20 switches to its low-voltage running condition.

It is an important feature of the present invention that the high transient voltage starting pulse is applied to the lamp 15 through the spark gap 70. This concentrates the high voltage in the lamp, feedback of the high-voltage transient to the power supply 20 being prevented by the choke coil 45*a*. Thus, the power dissipation inherent in prior art coupling arrangements is avoided, thereby providing more efficient operation of the circuit 10. Furthermore, it will be appreciated that the spark gap 70 serves to prevent feedback of the DC voltage to the autotransformer 67 from the lamp 15. This is important, since this DC voltage would saturate the autotransformer 67 and prevent operation of the starting circuit 60. It will also be understood that feedback of the transient high-voltage starting pulse to the power supply 20 is further prevented by the diodes 46 and 47, as well as by the operation of the choke coil 45*a*. Similarly, feedback of the discharge current of the capacitor 51 to the power supply 20 is prevented by the diode 46.

In a constructional model of the circuit 10 for starting and operating a 1 KVA mercury vapor discharge lamp, the transformer 30 has the output voltages recited above, the values of the capacitors 34, 51 and 62 are, respectively, 12 microfarads, 220 microfarads and 40 microfarads, while the value of the capacitor 71 is 1,500 picofarads. The values of the resistors 50, 52, 61 and 64 are, respectively, 10 ohms, 20 K ohms, 5 K ohms and 4.7 K ohms. The varistors 41, 43 and 44 are metal oxide varistors. In this embodiment of the circuit 10 when connected to a 115-volt AC source, the input power factor to the lamp 15 was 99.9%. This substantially unity power factor at nominal input voltage is an important advantage since it obviates the use of the high capacitance necessary in some prior art circuits for power factor correction. The efficiency of the circuit 10 when connected to the 115-volt AC supply was approximately 80%.

It will be appreciated that for different types of lamps requiring different starting and operating voltages, the values of the various circuit elements will change accordingly.

Figure 7:
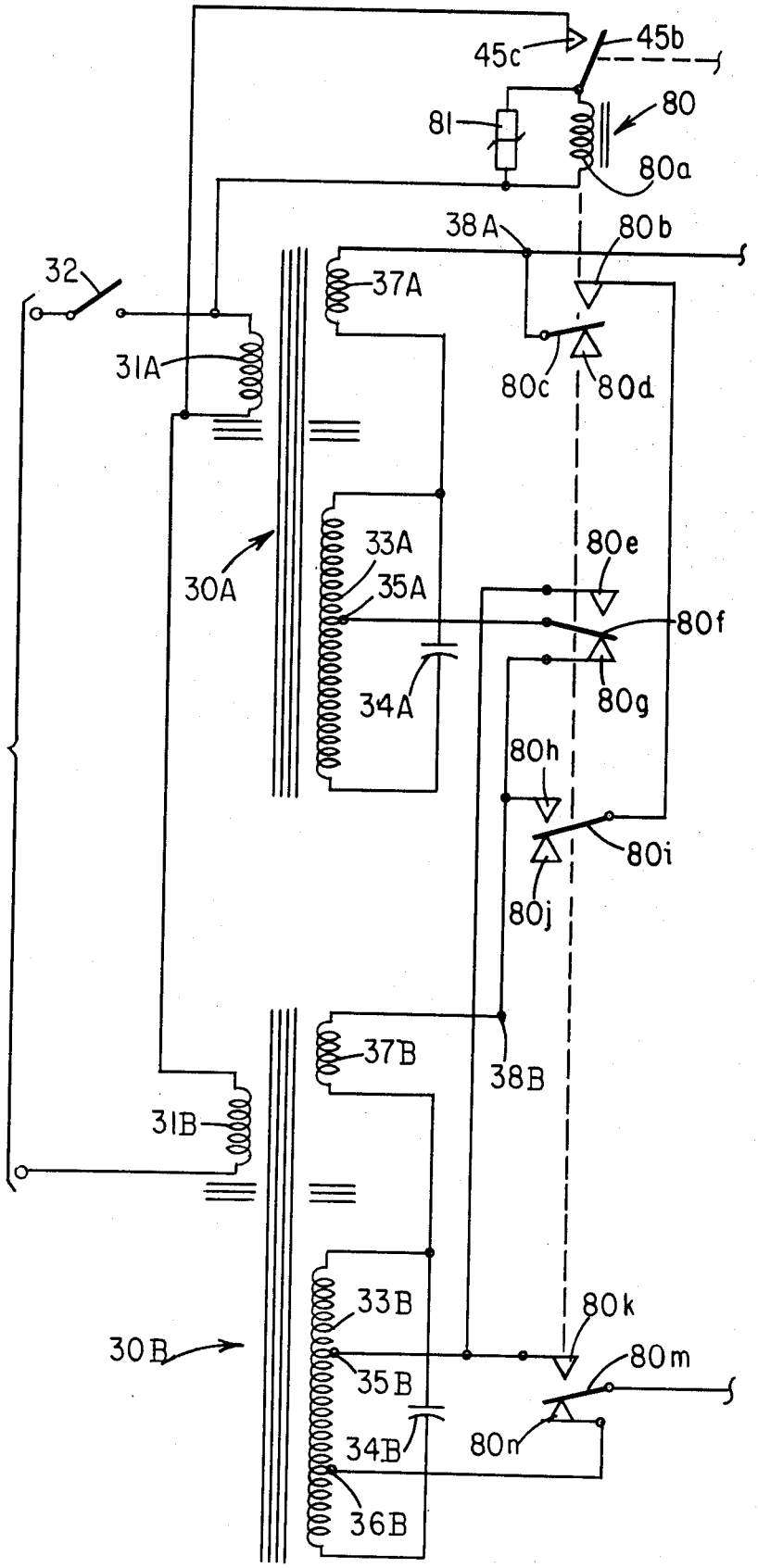
FIG. 7 is a schematic circuit diagram of another embodiment of the switched AC portion of the power supply.

Referring now to FIG. 7 of the drawings, there is illustrated an alternative embodiment of the AC portion of the power supply 20 of the present invention, designed for use in higher power applications, such as a 2 KVA lamp. While it is possible to use the power supply 20 of FIG. 1 in such high power applications, it requires the use of a larger transformer. It has been found that a constant-voltage current-limiting transformer having the necessary voltage rating can be considerably more than twice as expensive as the lower voltage transformer. Thus, the circuit of FIG. 7 has been devised which utilizes two transformers, each of which is substantially identical in construction to the transformer 30 of FIG. 1, and which are respectively designated by the numerals 30A and 30B. The parts of each of the transformers 30A and 30B bear the same reference numerals as the corresponding parts of the transformer 30, followed by the letter suffix A or B.

The transformers 30A and 30B are respectively provided with single primary windings 31A and 31B which are connected in series across the associated AC line voltage. The transformer 30A has a secondary winding 33A with a single intermediate tap 35A thereon corresponding to the low-voltage tap 35 of the transformer 30, while the secondary winding 33B of the transformer 30B has two intermediate taps 35B and 36B thereon, respectively corresponding to the low and high-voltage taps 35 and 36 of the transformer 30 in FIG. 1.

Connected in series across the primary winding 31A of the transformer 30 are a coil 80*a* of a relay 80 and the normally open contacts 45*b* and 45*c* of the magnetic reed relay 45. The relay 80 is a four-pole, double-throw relay, the first pole comprising fixed contacts 80*b* and 80*d* and movable contact 80*c*, the second pole comprising fixed contacts 80*e* and 80*g* and movable contact 80*f*, the third pole comprising fixed contacts 80*h* and 80*j* and movable contact 80*i* and the fourth pole comprising fixed contacts 80*k* and 80*n* and movable contact 80*m*. The output terminal 38A of the transformer 30A is connected to the movable contact 80*c* of the relay 80, the intermediate tap 35A is connected to the movable contact 80*f*, the output terminal 38B of the transformer 30B is connected to the fixed contacts 80*g* and 80*h*, the intermediate tap 35B is connected to the fixed contacts 80*e* and 80*k* and the intermediate tap 36B is connected to the fixed contact 80*n*. The movable contacts 80*c* and 80*m* of the relay 80 are respectively connected to the input terminals of the diode bridge 42 (see FIG. 1), and the movable contact 80*i* is connected to the fixed contact 80*b*. A varistor 81 is connected in parallel with the coil 80*a* of the relay 80 to protect the solid-state circuits from inductive voltage spikes of the relay coil 80*a*.

From the foregoing, it can be seen that when the movable contacts of the relay 80 are in the starting position illustrated in FIG. 7, the secondaries of the transformers 30A and 30B are connected in series across the input terminals of the diode bridge 42, this series path extending from the movable contact 80*c* through the compensating winding 37A and the upper portion of the secondary winding 33A of the transformer 30A, the intermediate tap 35A, the movable contact 80*f* and fixed contact 80*g* of the relay 80, the compensating winding 37B and secondary winding 33B and tap 36B of the relay 30B and the fixed contact 80*n* and movable contact 80*m* of the relay 80. In this configuration, the AC voltage applied across the input terminals of the diode bridge 42 is approximately 500 volts, with approximately 200 volts of this total being taken from the transformer 30A and approximately 300 volts from the transformer 30B. This high voltage, together with the voltage transient applied by the starting circuit 60, is sufficient for starting a 2 KVA lamp in either the hot or cold condition thereof.

Once the lamp is ignited, the relay contacts 45*c* and 45*b* close in the manner described above in connection with FIG. 1, thereby energizing the relay 80 and switching it to its low-voltage or running condition, wherein the movable contacts 80*c*, 80*f*, 80*i* and 80*m* are respectively connected to the fixed contacts 80*b*, 80*e*, 80*h* and 80*k*. It will be seen that in this latter low-voltage, or running configuration, the secondaries of the transformers 30A and 30B are connected in parallel across the input terminals of the diode bridge 42. More particularly, the output terminal 38A of the transformer 30A is connected to the movable contact 80*c* of the relay 80, and the output terminal 38B of the transformer 30B is also connected to the movable contact 80*c* via the fixed contact 80*h*, movable contact 80*i* and fixed contact 80*b*. In like manner, the intermediate taps 35A and 35B are both connected to the movable contact 80*m*, the latter via the fixed contact 80*k* and the former via the movable contact 80*f* and the fixed contacts 80*e* and 80*k*. Thus, in this running condition, the voltage applied to the input terminals of the diode bridge 42 will be the 200 VAC which is available at the intermediate taps 35A and 35B of each of the transformers 30A and 30B.

Thus, it can be seen that in this embodiment two constant-voltage current-limiting transformers are utilized together with a relay which switches the transformers between series and parallel connection for switching between the high and low-voltage conditions of the circuit 10. The remainder of the circuit 10 is substantially the same as illustrated in FIG. 1, except for component values. In this regard, it may be necessary to replace the capacitor 51 with two capacitors in series, each with a bleeder resistor. This is because electrolytic capacitors which will handle 500 volts are not readily commercially available. It will be appreciated that the concept of utilizing series and parallel arrangements of plural transformers, illustrated in FIG. 6, can be utilized for combining greater numbers of transformers in still higher power applications, with even greater cost savings.

From the foregoing, it can be seen that there has been provided an improved circuit for starting and operating a gas discharge lamp, whether hot or cold, and affording controlled rapid warm-up of a cold lamp while, at the same time, providing important voltage-regulating and current-limiting functions, high efficiency and substantially unity power factor.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A circuit for starting and operating a gas discharge lamp comprising means connecting the lamp to an associated source of DC voltage, a starting circuit for producing a transient pulse of starting voltage sufficiently high to ignite the lamp when it is warm, and spark gap means connected to said starting circuit and connected directly to the lamp for coupling said transient starting voltage pulse to the lamp to start same while preventing feedback of the DC voltage to said starting circuit.

2. The circuit of claim 1, wherein said means connecting the lamp to the associated source of DC voltage includes means preventing feedback of said transient voltage pulse to the DC source.

3. The circuit of claim 1, wherein said starting circuit includes a storage capacitor connected to the source of DC voltage for charging thereby, autotransformer means connected to said spark gap means, and discharge means connected between said capacitor and said autotransformer and responsive to a predetermined voltage across said capacitor for discharging same through said autotransformer to produce said transient voltage pulse.

4. The circuit of claim 3, wherein said discharge means includes a silicon controlled rectifier having an anode connected to said capacitor and a cathode connected to said autotransformer and a gate electrode, and a resistor and a diac connected in series between said anode and said gate electrode for triggering said silicon controlled rectifier to a conductive state when the voltage on said capacitor reaches said predetermined voltage.

5. A circuit for starting and operating a gas discharge lamp comprising power supply means connected to the lamp and shiftable between a normal starting condition for applying a relatively high DV voltage to the lamp and a running condition for applying a relatively low DC voltage to the lamp; said power supply means including a constant-voltage transformer having primary winding means adapted for connection to an associated source of AC voltage and secondary winding means having first and second and third terminals, and rectifying means selectively connectable between said first and second terminals in said running condition or between said first and third terminals in said starting condition; control means coupled to said power supply means and to the lamp and operative for shifting said power supply means to the running condition thereof in response to starting of the lamp and for shifting said power supply means to the starting condition thereof in response to extinguishing of the lamp; and starting means coupled to said power supply means and to the lamp and responsive only to the relatively high DC voltage when said power supply means is in the starting condition thereof for producing a transient pulse of starting voltage and applying it to the lamp for starting thereof.

6. The circuit of claim 5, wherein said power supply means in the starting condition thereof provides a voltage of approximately 400 VDC and in the running condition thereof provides a voltage of approximately 150 VDC.

7. The circuit of claim 5, and further including energy storage means connected to said power supply means and to the lamp and responsive to shifting of said lamp from said starting condition to said running condition thereof for supplying current to the lamp to maintain the lamp lighted during the shifting of said power supply means.

8. The circuit of claim 5, wherein said transformer is a ferroresonant, current-limiting transformer.

9. A circuit for starting and operating a gas discharge lamp comprising power supply means connected to the lamp and shiftable between a normal starting condition for applying a relatively high DC voltage to the lamp and a running condition for applying a relatively low DC voltage to the lamp, first control means coupled to said power supply means and operable in first and second conditions respectively for shifting said power supply means to the starting and running conditions thereof, second control means coupled to said first control means and connected in series with the lamp and responsive to the lamp current for shifting said first control means to the second condition thereof in response to starting of the lamp and for shifting said first control means to the first condition thereof in response to extinguishing of the lamp, and starting means coupled to said power supply means and to the lamp and responsive only to the relatively high DC voltage when said power supply means is in the starting condition thereof for producing a transient pulse of starting voltage and applying it to the lamp for starting thereof.

10. The circuit of claim 9, wherein each of said first and second control means includes a relay.

11. The circuit of claim 10, wherein said second control means includes a choke coil connected in series with the lamp for isolating said power supply means from the transient voltage pulse applied to the lamp, said choke coil being responsive to lamp current for producing a magnetic flux, and relay means responsive to said magnetic flux for controlling said first control means.

12. The circuit of claim 9, wherein said power supply means includes a transformer having primary winding means connected to an associated source of AC power and secondary winding means having first and second and third terminals, and rectifying means selectively connectable between said first and second terminals in said running condition or between said first and third terminals in said starting condition, said first control means comprising a relay having a coil connected across said primary winding and a movable contact movable between said second and third terminals of said secondary winding means, said second control means including relay means having contacts connected in series with said first relay coil and a coil connected in series with the lamp.

13. A circuit for starting and operating a gas discharge lamp comprising power supply means connected to the lamp and shiftable between a normal starting condition for applying a relatively high DC voltage to the lamp and a running condition for applying a relatively low DC voltage to the lamp, control means coupled to said power supply means and to the lamp and operative for shifting said power supply means to the running condition thereof in response to starting of the lamp and for shifting said power supply means to the starting condition thereof in response to extinguishing of the lamp, a starting circuit coupled to said power supply means and responsive only to the relatively high voltage when said power supply means is in the starting condition thereof for producing a transient pulse of starting voltage sufficiently high to ignite the lamp when it is warm, and spark gap means connected to said starting circuit and connected directly to the lamp for coupling said transient voltage pulse to the lamp to start same while preventing feedback of the DC voltage to said starting circuit.

14. The circuit of claim 13, wherein said power supply means includes a ferroresonant constant-voltage current-limiting transformer, said circuit having an efficiency of approximately 80% and substantially unity power factor.

15. A circuit for starting and operating a gas discharge lamp comprising power supply means connected to the lamp and shiftable between a normal starting condition for applying a relatively high DC voltage to the lamp and a running condition for applying a relatively low DC voltage to the lamp; said supply means including two constant-voltage transformers each having primary winding means adapted for connection in series across an associated source of AC voltage and secondary winding means, rectifying means having input terminals, and switching means coupled to said secondary winding means and to the input terminals of said rectifying means and switchable between a first condition connecting said secondary winding means in series across said input terminals of said rectifying means in the starting condition of said power supply means and a second condition for connecting said secondary winding means in parallel across the input terminals of said rectifying means in the running condition of said power supply means; control means coupled to said power supply means and to the lamp and operative for shifting said power supply means to the running condition thereof in response to starting of the lamp and for shifting said power supply means to the starting condition thereof in response to extinguishing of the lamp; and starting means coupled to said power supply means and to the lamp and responsive only to the relatively high DC voltage when said power supply means is in the starting condition thereof for producing a transient pulse of starting voltage and applying it to the lamp for starting thereof.

* * * * *